US008353258B2

(12) United States Patent
Fitch

(10) Patent No.: US 8,353,258 B2
(45) Date of Patent: Jan. 15, 2013

(54) ROLL SUPPORT AND ROLL COATING APPARATUS

(76) Inventor: Michael Arthur Fitch, Willoughby (AU)

( * ) Notice: Subject to any disclaimer, the term of this patent is extended or adjusted under 35 U.S.C. 154(b) by 712 days.

(21) Appl. No.: 12/306,595

(22) PCT Filed: Jun. 26, 2007

(86) PCT No.: PCT/AU2007/000888

§ 371 (c)(1),
(2), (4) Date: Dec. 3, 2009

(87) PCT Pub. No.: WO2008/003124

PCT Pub. Date: Jan. 10, 2008

(65) Prior Publication Data

US 2010/0068403 A1 Mar. 18, 2010

Related U.S. Application Data

(60) Provisional application No. 60/818,562, filed on Jul. 5, 2006.

(51) Int. Cl.
*B05C 1/08* (2006.01)

(52) U.S. Cl. ..... 118/244; 118/249; 118/256

(58) Field of Classification Search ..... 118/244, 118/249, 256, 46; 101/247, 216, 218; 427/428.01, 427/428.08, 428.1, 428.21; 248/251
See application file for complete search history.

(56) References Cited

U.S. PATENT DOCUMENTS

| | | | | |
|---|---|---|---|---|
| 2,128,360 | A * | 8/1938 | Harrold et al. | 101/351.3 |
| 3,174,456 | A | 3/1965 | Boone | |
| 3,245,378 | A * | 4/1966 | Caple et al. | 118/126 |
| 5,431,731 | A | 7/1995 | Salo et al. | |
| 5,490,461 | A * | 2/1996 | Beaudoin | 101/483 |
| 2006/0162592 | A1 * | 7/2006 | Oberholzer | 101/153 |

FOREIGN PATENT DOCUMENTS

| | | | |
|---|---|---|---|
| GB | 925036 | A | 5/1963 |
| GB | 1073872 | A | 6/1967 |

* cited by examiner

*Primary Examiner* — Laura Edwards
(74) *Attorney, Agent, or Firm* — QuickPatents, Inc.; Kevin Prince

(57) ABSTRACT

A roll support apparatus suitable for use in a roll coating machine is described. The roll support apparatus includes a roll support frame for rotatably supporting a roll coating head roll associated with the roll support frame, the roll support frame adapted for pivoting movement relative to a roll support frame mounting base. Furthermore, a roll carriage suitable for use in a roll coating machine is described. The roll carriage includes a roll support frame for rotatably supporting a respective roll and further includes a roll support frame mounting for movably mounting the roll support frame so that it moves between a coating position and an idle position, wherein the roll support frame mounting in use is mounted substantially above the respective roll to inhibit contamination of the roll support frame mounting.

15 Claims, 5 Drawing Sheets

ROLL SUPPORT AND ROLL COATING APPARATUS

FIELD OF THE INVENTION

The present invention relates generally to improved support of rolls associated with roll coating apparatus. Also, improved roll coating apparatus are also described which incorporate the improved roll support. Preferred embodiments of the present invention also relate to improved adjustment and application of force of the associated rolls, to adjacent rolls or surfaces.

Throughout this specification and the claims attached hereto, whenever the word "rolls" or "roll" or any grammatical derivation thereof is used, unless it is qualified, it is to be taken as extending to one or more of the rolls mounted on a roll-coating head, which in use coats a travelling metal web in the form of a sheet of steel or other metal. Therefore the term "roll" or "rolls" may include pick-up rolls, metering rolls, intermediate rolls, applicator rolls, and the like.

BACKGROUND TO THE INVENTION

Roll coating is a process of applying a coating to a metal strip whereby, at least in one known process, a first rotating roll is nip fed or partially immersed in coating liquid to receive a layer of coating, the first rotating roll then transferring the coating by contact either directly with the metal strip or with a counter-rotating applicator roll to apply the coating to the metal strip passing between the applicator roll and a back-up roll.

In the roll-coating process, a contact force must be applied between the first roll and the applicator roll, and from applicator roll to strip. It is important to accurately assess the magnitude of these forces. However, in known systems this is difficult because of deflection and resonance of roll support frames and other parts of the roll-coating heads, and because contamination of various moving parts by the coating increases resistance therebetween. It is also difficult to accurately assess the force between various rolls because of backlash and variable frictional resistance between parts of adjusting means.

Furthermore, known roll coating systems are difficult to operate because of an ergonomically poor instrumentation and/or adjustment layout.

Expensive parts must be used in known roll coaters to reduce contamination of sensitive measuring equipment, and because they are under high load and must be miniaturised to fit in small spaces.

The present invention seeks to ameliorate one or more of the abovementioned disadvantages.

SUMMARY OF THE INVENTION

According to one aspect of the present invention there is provided a roll support apparatus suitable for use in a roll coating machine, the roll support apparatus including: a roll support frame for rotatably supporting a roll coating head roll associated with the roll support frame, the roll support frame adapted for pivoting movement relative to a roll support frame mounting base.

Preferably a pivot mounting means is provided which is operatively connected to or integral with the roll support frame so that the roll support frame is adapted to pivot relative to the roll support frame mounting base about a pivot mount.

Preferably an adjustment means is provided to rotate the roll support frame about the pivot mount.

Preferably the roll support frame includes two end frame bodies disposed adjacent end regions of the roll, the end frame bodies including a rolling mounting for mounting the one or more rolls and a truss structure to increase strength of the roll support frame.

Preferably the end frame bodies are in the form of a solid wall which is generally triangular so as to reduce deflection of the end frame body.

Preferably the adjustment means is disposed in an adjustment zone which is disposed at a selected distance from the pivot mount so that in use it may provide a torque about the pivot mount and to inhibit contamination of the adjustment means.

Preferably, the side frame body is in the form of a pivoting link.

The roll support frame may be disposed substantially above or below the roll. In some embodiments, such as in a machine known as a quick change C-wrap coater, a first roll carriage is mounted below a rolling axis of a back-up roll, and a second roll carriage is mounted above the rolling axis of the same backup roll. The advantage of the roll carriages being oriented in this fashion is that the applicator rolls may be disposed relatively close to one another on the same backup roll, and reduces additional height requirement of known roll carriages.

Preferably the pivot mount includes deep groove ball bearings. The associated frictional resistance of the pivot system is negligible In use the roll carriages form part of a roll coating head which is adapted to apply a force between an applicator roll mounted on the coating head and a coil passing around a back up roll mounted on a coil or strip feeding assembly. The applicator roll in a coating position abuts a counter-rotating pick up roll or intermediate roll which is loaded with paint or other coating, having been loaded by being immersed in and rotated in a reservoir filled with coating fluid, or nip fed. The coating fluid is transferred to the applicator roll which in turn transfers the coating to the travelling sheet or coil. An intermediate roll may be used so as to provide further metering and/or smoothing of the coating.

The present invention may be used in C-wrap coaters, S-wrap coaters, vertical coaters, horizontal coaters, U-wrap coaters and finish A and finish B coaters.

The roll which is supported by the roll support apparatus of the present invention may be any one of the: applicator rolls; intermediate or metering roll; or the pick-up roll. In one embodiment, the roll support frame supporting the applicator roll is known as the applicator link. A second link is mounted on the applicator link, the latter of which forms the relatively fixed roll support mounting base for the second link.

Preferably a splice traverse mechanism is provided, which in use moves the roll carriage between a coating position wherein the applicator roll abuts the strip and an idle position where the applicator roll is spaced from the strip.

A third roll carriage may be provided wherein a third link is mounted on the second link, wherein that second link forms the relatively fixed roll support apparatus mounting base for the third link. The third link and carriage provides improved metering and accuracy of coating thickness.

The adjusting means may include an adjustable mount disposed in an adjusting zone, which is spaced a selected distance from the pivot so as to inhibit contamination of the adjusting means. The adjustable mount may be a linear actuator so that a linear movement of the spaced region of the roll support assembly results in a rotation of the roll support assembly about the pivot mounting means. The linear actuators may be actuated by hand wheels, stepper motors, or servomotors or the like.

A swivel assembly may be provided which allows the rotation of the roll support assembly without bending the linear actuator.

The swivel assembly may be in the form of arched clevis links or double arched clevis links. The adjusting zone may include linear actuators and force transducers associated therewith and may be protected from coating spills and other contaminants by being spaced far from any application zone (at the interface between any of the rolls).

According to another aspect of the present invention there is provided a roll carriage suitable for use in a roll coating machine having one or more rolls, the roll carriage including: a roll support frame for rotatably supporting a respective roll; the roll carriage including a roll support frame mounting means for movably mounting the roll support frame so that it moves between a coating position and an idle position, wherein the roll support frame mounting means in use is mounted substantially above the respective roll to inhibit contamination of the roll support frame mounting means.

Preferably the roll support assembly is in the form of a roll support frame as described above. The mounting means of the immediately abovementioned aspect of the present invention may be in the form of a linear bearing and linear mounting apparatus. However, in a preferred embodiment, the mounting means is in the form of a pivot mount and roller bearing as described above. The pivot of both aspects of the present invention described herein, may be disposed at any convenient location. However, in a preferred embodiment the pivot is disposed in a location on the coating head which is spaced far from coating spray or spills, and preferably disposed at a location which is on a tangent line to both abutting rolls. This arrangement protects the bearing from contamination. One reason for being on the tangent line is in order to give an accurate linear relationship of actuator force output to roll nip force pressure, for all operational roll diameters.

The reduction of contamination in the bearings arrests a decay in the accuracy of the coating head application force throughout the life of the head.

Preferably the adjusting means in spaced a selected distance from the contamination zone, also arresting decay in the accuracy of the head, also reducing maintenance and down time. Also, the adjusting means and may be spaced far from the pivot, so as to reduce the actuator force requirement with respect to the roll nip pressure and also allows a larger space to site the linear actuators, so that highly accurate load cells may be used.

Preferably a height adjustable coating reservoir is attached to a pick-up roll link and includes a levelling arm which maintains the reservoir in a level position.

BRIEF DESCRIPTION OF THE DRAWINGS

In order to enable a clearer understanding of the invention, drawings illustrating example embodiments are attached, and in those drawings:

FIGS. 2 to 5 are similar side elevation views to that shown in FIG. 1, wherein the roll carriages and coating heads are applied in coating arrangements such as:

Figure 2:
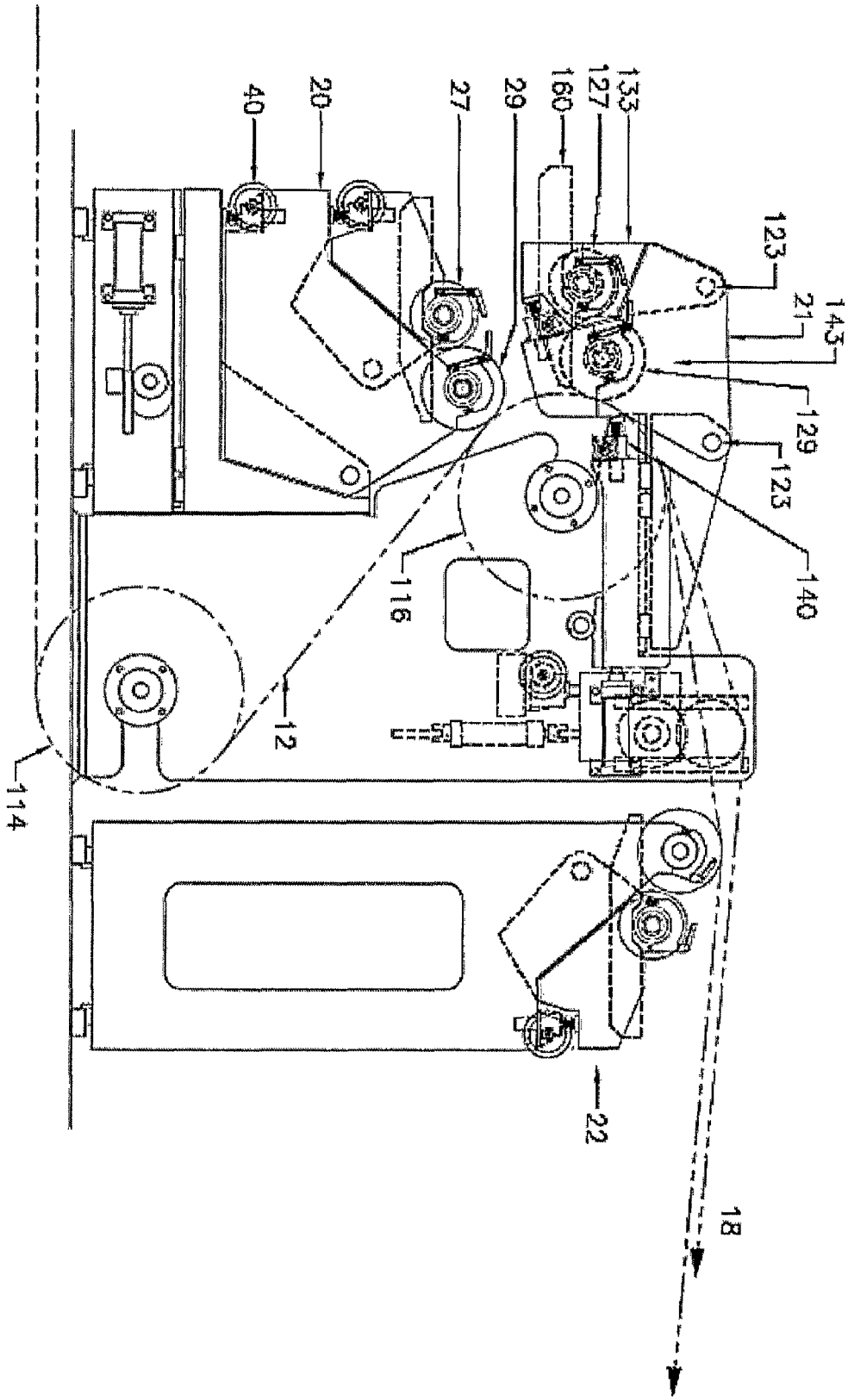
Figure 3:
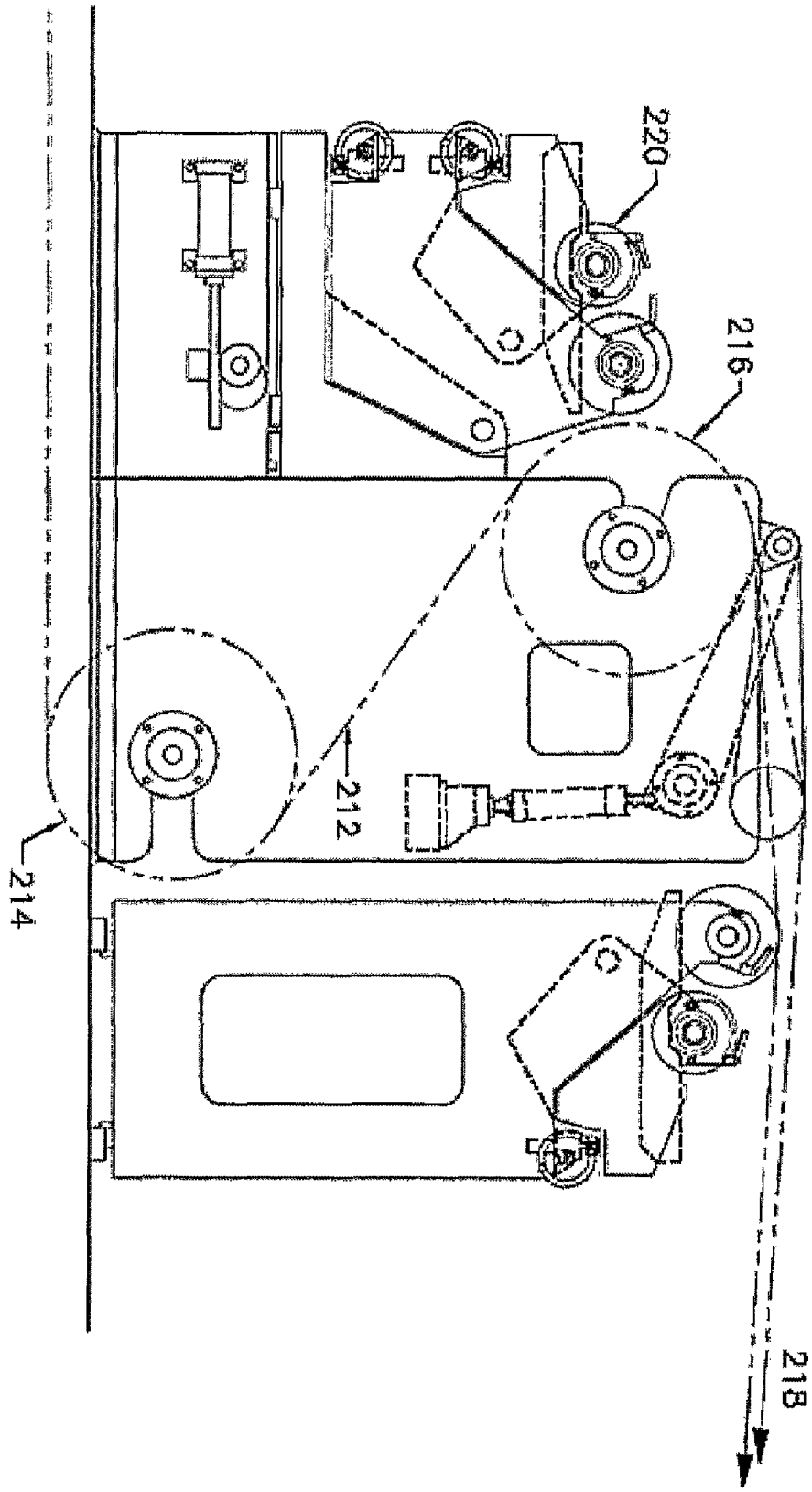
Figure 4:
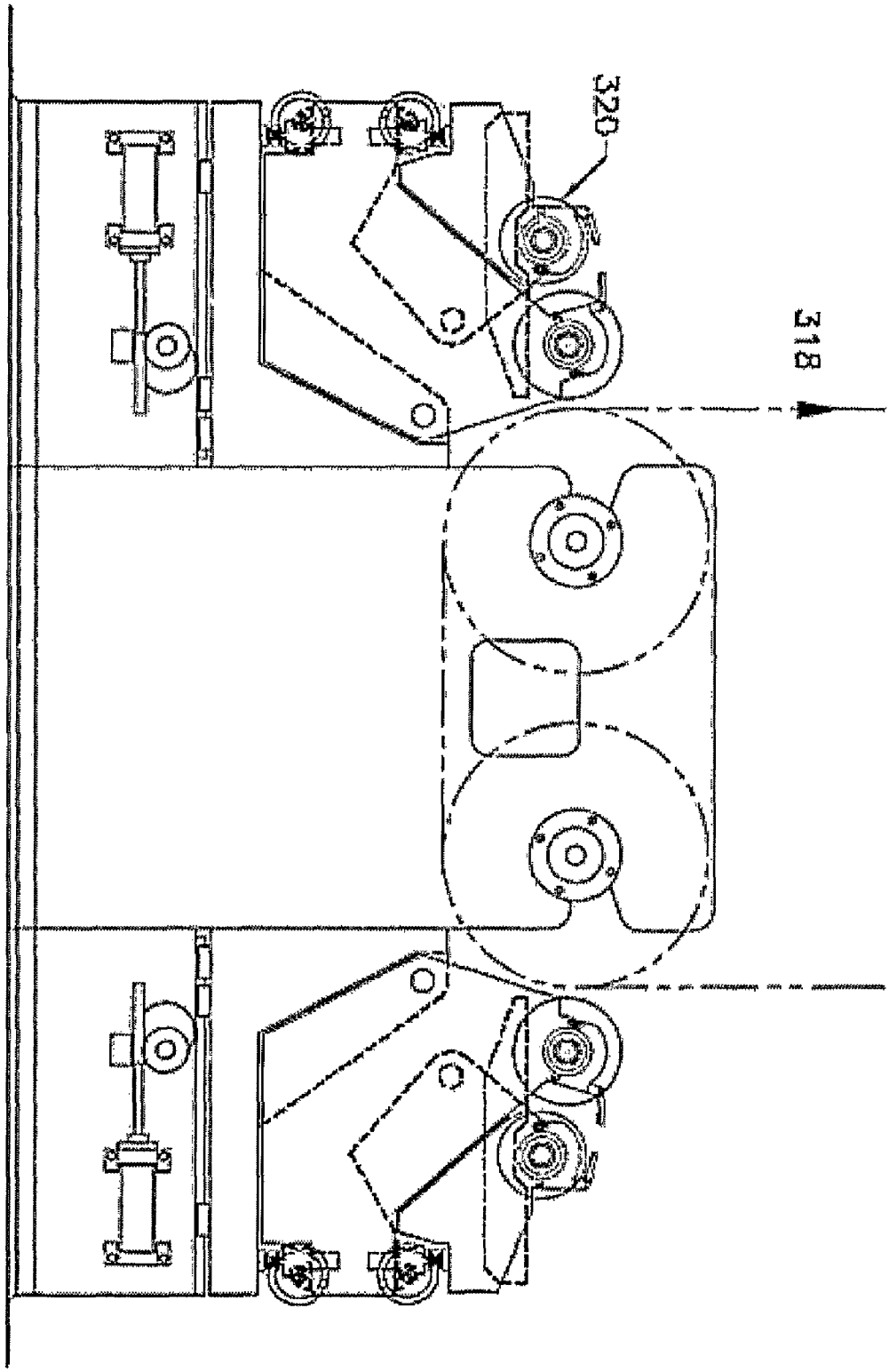

Quick change S-wrap coater (FIG. 2);

S-wrap coater (FIG. 3);

U-wrap coater (FIG. 4); and

Figure 5:
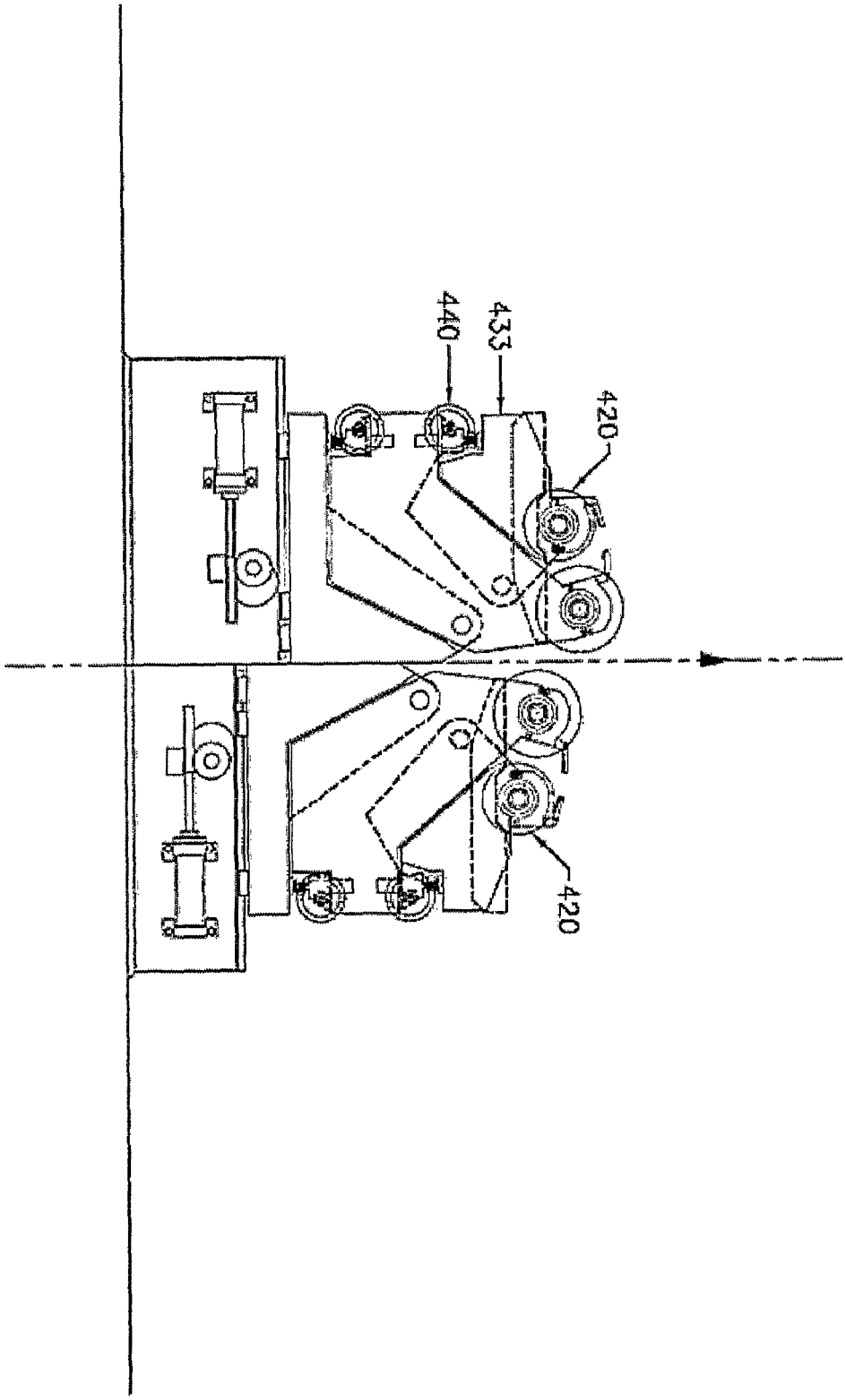

Vertical coater (FIG. 5).

Referring to the drawings there is shown a roll coating assembly generally indicated at 10. In use, a strip 12 passes around turn roll 14 and back-up roll 16 and is then coiled in an area not shown, which is generally to the right of the drawings pages and/or in the direction of arrows 18. In a coating position, a coating head 20 abuts the strip 12 to apply a coating to one side of the strip 12. Other coating heads may add other coatings to the strip 12, either on the same side (head 21) or to an underside (head 22 in FIG. 2).

Coating head 20 includes two roll support apparatus 24, 26 in the form of roll support frames 33 and 43, each of the roll support frame 33 and 43 rotatably supporting a roll 25.

Roll support fame 33 supports pick-up roll 27 and roll support frame 43 supports applicator roll 29. Roll support frame 33 is mounted by pivot mounting means 23 on a roll support frame mounting base 28 which is in the form of roll support frame 43 for pivoting movement relative thereto. Roll support frame 43 is mounted by pivot mounting means 23 on a roll support frame mounting base 28 which is in the form of a roll support frame carriage 30.

The roll support frames 33 and 43 are in the form of a link 35, and 45. Roll support frame 33 includes a brace region 37 so as to form a truss 38 which is filled in to form a solid wall 39.

Mounting means 23 includes a pivot mount 32. The pivot mount 32 includes deep groove ball or roller bearings 34.

An adjusting means 40 is provided so as to pivot the roll support frame 33 relative to the roll support frame 43, about the pivot mount 32. The adjusting means 40 is in the form of a linear actuator 42 which may be actuated by a manual actuator wheel 44 or a stepper motor or a servo motor (not shown). The adjusting means 40 includes an allowance means such as a swivel 46 so as to allow the rotation of the roll support frame 33 without bending the linear actuator 42. The swivel 46 includes an arched clevis link or links 48 and 49.

Adjusting means 140 is provided so as to pivot the roll support frame 43 relative to roll support carriage 30, about pivot mount 132. Rather than repeat the paragraph immediately above, it is noted that like parts of adjusting means 40 are denoted with like numerals in adjusting means 140, and similarly with regard to pivot mount 32 and 132. Although not shown, a third roll mounted on a pivoting support frame may be mounted on roll support frame 33 so as to pivot relative thereto.

The adjusting means 40 is spaced a selected distance from the pivot 32 so as to increase mechanical advantage. The adjusting means 40 is also spaced from the pivot 32 and a contamination zone 51 to reduce contamination of motors, threads and the like with paint and other coatings, to inhibit friction build up in those mechanisms.

A force measuring apparatus 50 in the form of load transducers 52 is provided. The force measuring apparatus is disposed adjacent the adjusting means 40 so as to reduce contamination, and to allow a larger unit to be installed. This allows a more accurate device to be used.

The pivot mount 32 is also spaced from the contamination zone 51 so as to reduce friction build up. The pivot mount 32 is disposed at a location on a tangent 80 common to back up roll 16 and applicator roll 29, so that a force applied to the strip 12 by the linear actuator 42 is easily calculated, and transferred without excessive loss, as well as to given an exact linear on a tangent line to roll contact points in order to give an exact linear relationship of actuator force output to roll nip force pressure, for all operational roll diameters.

A coating reservoir 60 is provided, mounted on a coating pan support mechanism. The coating pan support mechanism 62 is attached to roll support frame 33 so the pan support 62 moves with the frame 33 and inhibits reservoir 60 contact with a pick up roll neck 64 when the height of the reservoir 60 is adjusted. A leveller arm 65 is provided to maintain reservoir 60 at a level disposition.

The roll support frame carriage 30 includes a cam system 70 so that acceleration may be gradually increased and decreased, so that the coating in the reservoir 60 is not spilt when head 20 is moved to or from a standby position.

Figure 1:
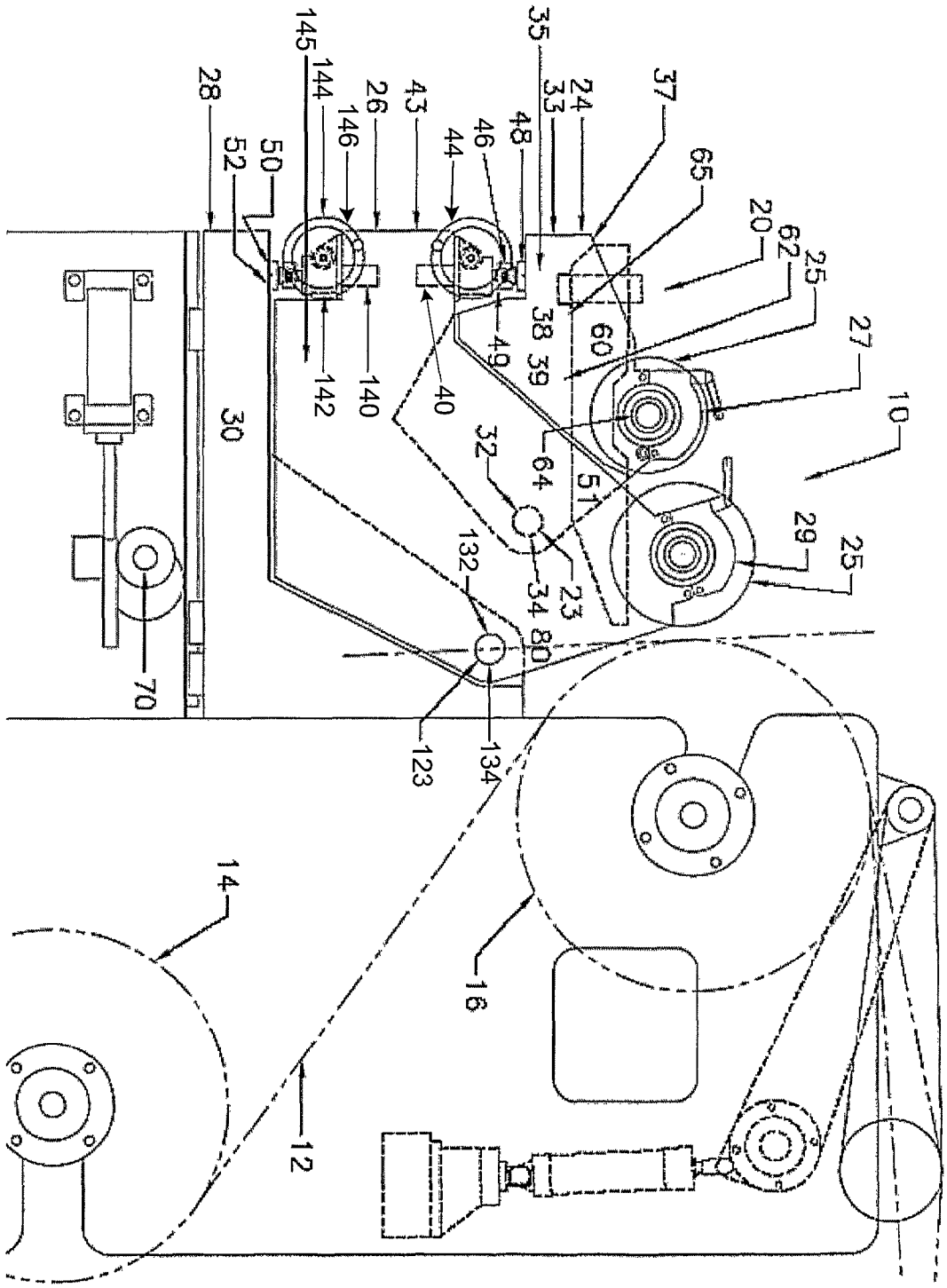
FIG. 1 is a side elevation view of a coating head incorporating a roll carriage according to a preferred embodiment of the present invention.

In operation, the head 20 is moved by the roll support frame carriage 30 into the coating position shown in FIG. 1. In that Figure, the linear actuator 142 has been extended to pivot the frame 43 about roll support carriage 30 so that the applicator roll 29 abuts the strip 12. The force applied by the actuator 142 is known to a high accuracy due to the rigidity and low deflection of the solid walls 39 of the truss 38, and the low resistance at the contact point of the deep groove ball bearings 34. The adjusting means 40 is also extended so as to pivot frame 33 relative to frame 43 so as to apply a metering or other force to applicator roll 29 via pick up roll 27. The rolls are rotated, roll 29 rotating one way and roll 27 rotating the other, and the passing strip 12 is coated.

Advantageously, the frictional dead band and deflection, and resonance associated with known designs are reduced with preferred embodiments of the present invention. The reduction of the above described accuracy problems are facilitated by the pivoting nature of the roll support frame, its rigidity because of the truss and brace, and reduction of contamination of moving parts because of their location away from contamination zones.

Accuracy of metering of the coating is improved by using a roll support assembly 24 of the present invention, mounted on the roll support frame 43, which is a relatively fixed base for the frame 33. The same advantages in accuracy of force measurement are obtained by the same design as for the assembly 26.

In the above described coating head assembly 20, the frames, 33 and 43 support the rolls, 27 and 29 respectively, from underneath.

However, in the coating head 21, the rolls (127 and 129) are supported from above. This allows a better ergonomic design because all linear actuators for heads 20 and 21 may be disposed in the same area for adjustment. Also the applicator rolls 29 and 129 may be applied to the strip 12, very close to one another on the backup roll arc.

This support of the applicator roll 129 and pick up roll 127 need not be limited to pivoting frames 133 and 143, though it is preferred.

The frames 133 and 143 may be sliding frames, mounted on linear bearings (not shown).

The description herein applies to all figures, like numerals denoting like parts, as indicated in the abovementioned examples.

Finally, it is to be understood that the inventive concept in any of its aspects can be incorporated in many different constructions so that the generality of the preceding description is not to be superseded by the particularity of the attached drawings. Various alterations, modifications and/or additions may be incorporated into the various constructions and arrangements of parts without departing from the spirit or ambit of the invention.

The invention claimed is:

1. A roll support apparatus suitable for use in a roll coating machine, the roll support apparatus including: a roll support frame mounting base; and a roll support frame assembly which comprises a first roll support frame for rotatably supporting a first roll, the roll support frame adapted for pivotal movement relative to the roll support frame mounting base, and a second roll support frame for rotatably supporting a second roll, the second roll support frame mounted to and adapted for pivotal movement relative to the first roll support frame, and wherein the first and second rolls are adapted to be in rolling contact when the apparatus is in use, wherein each roll support frame includes two end frame bodies disposed adjacent end regions of the roll, each end frame body Including a roll mounting for rotatably mounting one or more rolls and being formed as a truss structure to increase strength of the roll support frame.

2. A roll support apparatus as claimed in claim 1, wherein each end frame body is a generally triangular wall so as to reduce deflection of the end frame body.

3. A roil support apparatus as claimed in claim 1 wherein the first roll is an applicator roll for applying coating to a passing sheet or coil by contact therewith, and wherein the second roil is a metering roll or pick up roll.

4. A roll support apparatus suitable for use in a roll coating machine, the roll support apparatus including: a roll support frame mounting base; and a roll support frame assembly which comprises a first roll support frame for rotatably supporting a first roll, the roll support frame adapted for pivotal movement relative to the roll support frame mounting base, and a second roll support frame for rotatably supporting a second roll, the second roll support frame mounted to and adapted for pivotal movement relative to the first roll support frame, and wherein the first and second rolls are adapted to be in rolling contact when the apparatus is in use;

wherein by the roll support frame mounting base is a roll support frame carriage for moving the roll support frame assembly between an idle position and a coating position;

wherein a splice traverse mechanism is provided to move the roll support frame assembly between the idle and coating positions, said mechanism being operatively connected to or integral with the roll support frame carriage.

5. A roll support apparatus suitable for use in a roll coating machine, the roll support apparatus including: a roll support frame mounting base; and a roll support frame assembly which comprises a first roll support frame for rotatably supporting a first roll, the roll support frame adapted for pivotal movement relative to the roll support frame mounting base, and a second roll support frame for rotatably supporting a second roll, the second roll support frame mounted to and adapted for pivotal movement relative to the first roll support frame, and wherein the first and second rolls are adapted to be in rolling contact when the apparatus is in use;

wherein pivot mounts are provided which are operatively connected to or integral with the first and second roll support frames so that the roll support frames are adapted to pivot relative to the roll support frame mounting base about the pivot mount;

wherein an adjustment means is provided to rotate each respective roll support frame about the pivot mount;

wherein each adjustment means is powered by a hand wheel, stepper motor or servo motor.

6. A roll support apparatus as claimed in claim 5 wherein the adjustment means is disposed at a selected distance from the pivot mount to provide a torque about the pivot mount and to inhibit contamination of the adjustment means by coating liquid.

7. A roll support apparatus as claimed in claim 6 wherein by the adjustment means is in the form of a linear actuator so that a linear movement thereof effects an angular rotation of the roll support frame about the pivot mount.

8. A roll support apparatus as claimed in claim 7 wherein the adjustment means includes an allowance means to smoothly facilitate changing of a force application angle between the linear actuator and the roll support frame.

9. A roll support apparatus as claimed in claim 8 wherein the allowance means includes a swivel so that the linear actuator force is generally coincident with a longitudinal axis of the linear actuator regardless of the length of extension of an extending element of the linear actuator.

10. A roll support apparatus as claimed in claim 9 wherein the swivel includes arched clevis links or double arched clevis links.

11. A roll support apparatus claimed in claim 5 wherein the pivot mounts are above the rolls when the apparatus is installed in a roll coating machine.

12. A roil support apparatus as claimed in claim 5 wherein the pivot mounts are below the rolls when the apparatus is installed In a roll coating machine.

13. A roll support apparatus as claimed in claim 5 wherein each pivot mount includes deep groove ball bearings.

14. A roll coating head including a roll support apparatus as claimed in claim 1.

15. A roll coating machine including a roll coating head as claimed in claim 14.

* * * * *